US011549780B1

(12) United States Patent
Henderson

(10) Patent No.: US 11,549,780 B1
(45) Date of Patent: Jan. 10, 2023

(54) ACCURACY RING FOR FIREARMS

(71) Applicant: David F. Henderson, Las Vegas, NV (US)

(72) Inventor: David F. Henderson, Las Vegas, NV (US)

( * ) Notice: Subject to any disclaimer, the term of this patent is extended or adjusted under 35 U.S.C. 154(b) by 0 days.

(21) Appl. No.: 17/374,773

(22) Filed: Jul. 13, 2021

(51) Int. Cl.
*F41C 23/12* (2006.01)

(52) U.S. Cl.
CPC ..... *F41C 23/12* (2013.01)

(58) Field of Classification Search
CPC ..... F41C 23/12; F41C 23/16; F41C 23/10; F41G 1/35
See application file for complete search history.

(56) References Cited

U.S. PATENT DOCUMENTS

| | | | | |
|---|---|---|---|---|
| 1,695,071 | A | 12/1928 | Villalpando | |
| 2,056,975 | A | 10/1936 | Michal, Jr. | |
| 3,758,978 | A | 9/1973 | Theodore | |
| 3,782,019 | A | 1/1974 | Venturini | |
| 4,271,623 | A | 6/1981 | Beretta | |
| 4,735,007 | A | 4/1988 | Gal | |
| 6,226,915 | B1 | 5/2001 | Kotsiopoulos | |
| 6,658,781 | B1 | 12/2003 | Bowen | |
| 6,698,127 | B2 | 3/2004 | Weber | |
| 8,117,782 | B2 * | 2/2012 | Gross | F41G 11/003 42/114 |
| 8,707,604 | B2 * | 4/2014 | Troy | F41A 23/10 42/72 |
| 8,757,040 | B1 * | 6/2014 | Galloway | F41C 23/02 89/1.42 |
| 9,194,649 | B2 * | 11/2015 | Nierenberg | F41C 23/08 |
| 9,194,651 | B2 | 11/2015 | Nierenberg | |
| 9,354,012 | B2 * | 5/2016 | Faifer | F41C 23/16 |
| D785,744 | S * | 5/2017 | Bosco | D22/108 |
| 10,066,900 | B2 | 9/2018 | Bowers | |
| D877,279 | S * | 3/2020 | Bofill | D22/108 |
| 10,782,092 | B2 | 9/2020 | Miller | |

(Continued)

FOREIGN PATENT DOCUMENTS

| | | |
|---|---|---|
| WO | 2018215625 A1 | 11/2018 |
| WO | 2021055277 A1 | 3/2021 |

OTHER PUBLICATIONS

"UTG Ultra Slim Angled M-LOK Foregrip, Matte Black", https://www.80-lower.com/products/utg-ultra-slim-angled-m-lok-foregrip-matte-black/ (Year: 2020).*

*Primary Examiner* — Joshua T Semick
(74) *Attorney, Agent, or Firm* — Dickinson Wright PLLC

(57) ABSTRACT

A ring accessory for a firearm, such as a pistol or a long gun, includes an upper portion configured to attach to a frame of the firearm beneath a barrel and forward of a trigger guard. A vertical portion extends vertically downward from the upper portion, and a horizontal portion is connected to the vertical portion, extending horizontally therefrom toward the trigger guard. The vertical portion and the horizontal portion, together, define a horizontally-elongated aperture configured to be gripped by two or more fingers of a non-shooting hand of a user, with the two or more fingers extending horizontally therethrough, and with a palm of the non-shooting hand supporting the firearm from beneath the horizontal portion. A method for holding a firearm by a person using a compact shooting stance is also provided.

11 Claims, 7 Drawing Sheets

(56) References Cited

U.S. PATENT DOCUMENTS

| | | | | |
|---|---|---|---|---|
| 2008/0209789 | A1* | 9/2008 | Oz | F41G 11/003 42/90 |
| 2011/0107643 | A1* | 5/2011 | Fitzpatrick | F41C 23/16 42/72 |
| 2016/0146573 | A1 | 5/2016 | Kunkel et al. | |
| 2019/0249969 | A1 | 8/2019 | Griffith et al. | |
| 2019/0390935 | A1* | 12/2019 | Purkiss | F41C 23/16 |

* cited by examiner

ACCURACY RING FOR FIREARMS

FIELD

The present disclosure relates generally to accessories for firearms, such as pistols and long guns. More specifically, the present disclosure relates to a ring accessory for holding a firearm at a position forward of its trigger.

BACKGROUND

Many different handgrips exist for holding firearms, such as pistols and rifles. Pistols typically use a single handgrip located just behind a trigger. Long guns, such as rifles and shotguns, typically use a forward handgrip located forward of the trigger for supporting the firearm with a non-shooting hand in a cradle position.

SUMMARY

The present disclosure provides a ring accessory for a firearm having a frame, a trigger guard, and a barrel. The ring accessory comprises an upper portion configured to attach to the frame of the firearm beneath the barrel and forward of the trigger guard, a vertical portion extending vertically downward from the upper portion, and a horizontal portion connected to the vertical portion and extending horizontally therefrom toward the trigger guard. The vertical portion and the horizontal portion, together, define a horizontally-elongated aperture configured to be gripped by two or more fingers of a non-shooting hand of a user, with the two or more fingers extending horizontally therethrough, and with a palm of the non-shooting hand supporting the firearm from beneath the horizontal portion.

The ring accessory of the present disclosure may provide several advantages over conventional firearm grips. Use of the ring accessory of the present disclosure may provide a compact stance that reduces the cross-sectional area of the user. The ring accessory may also reduce fatigue and barrel flip, allowing a user to have improved control, and/or reduced time to come back to target after firing one or more shots.

The present disclosure also provides a ring accessory for a firearm having a frame, a trigger guard, and a barrel. The ring accessory comprises a vertical tube extending parallel to the barrel and spaced apart therefrom. The ring accessory also comprises a first support member having an upper portion, a vertical portion, and a lower portion, the upper portion configured to fasten to the frame of the firearm beneath the barrel and forward of the trigger guard, the lower portion connected to the upper portion by the vertical portion and configured to hold the vertical tube. The vertical tube and the support member together define a horizontally-elongated aperture configured to be gripped by two or more fingers of a non-shooting hand of a user, with the two or more fingers extending horizontally therethrough, and with a palm of the non-shooting hand supporting the firearm from beneath the vertical tube.

The present disclosure also provides a method for holding a firearm by a person using a compact shooting stance. The method includes: placing a shooting hand around a handgrip of the firearm, with an index finger of the shooting hand in position to pull a trigger of the firearm; installing a ring accessory onto a frame of the firearm, with an upper portion of the ring accessory attached to the frame of the firearm beneath a barrel of the firearm and forward of a trigger guard of the firearm, and the ring accessory including a vertical portion and a horizontal portion, with the vertical portion and the horizontal portion together defining a horizontally-elongated aperture; and gripping the ring accessory with a non-shooting hand, with two or more fingers of the non-shooting hand extending horizontally through the horizontally-elongated aperture, and with a palm of the non-shooting hand supporting the firearm from beneath the horizontal portion.

BRIEF DESCRIPTION OF THE DRAWINGS

Further details, features and advantages of designs of the invention result from the following description of embodiment examples in reference to the associated drawings.

DETAILED DESCRIPTION

Figure 1:
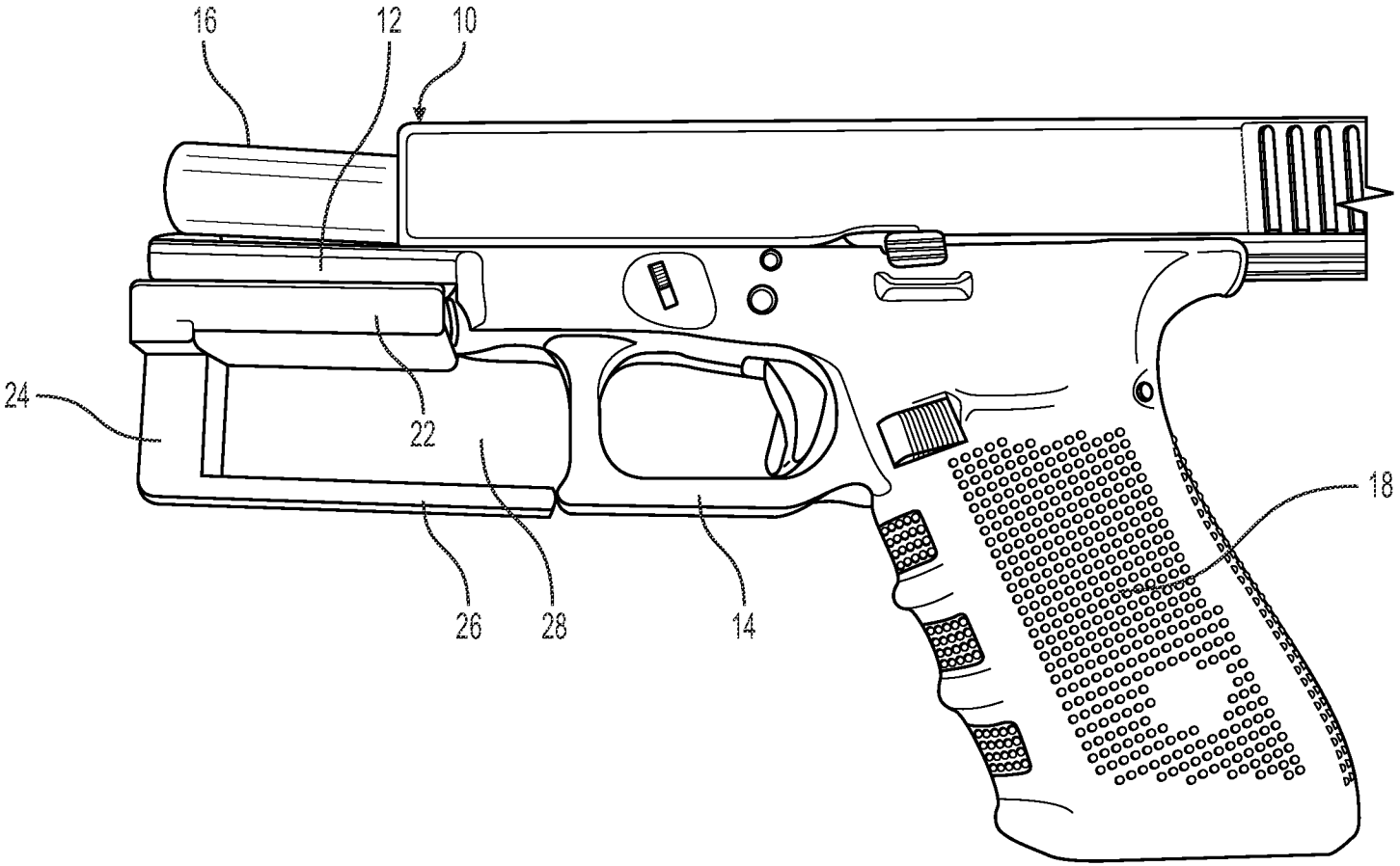
FIG. 1 shows a pistol with a ring accessory for a firearm mounted thereto, in accordance with an aspect of the present disclosure.

Referring to the drawings, the present invention will be described in detail in view of following embodiments. The present disclosure provides a ring accessory 20, 120 for a firearm such as a pistol 10 or a long gun. A long gun may include, for example, a rifle, shotgun, muzzle loader, etc. The ring accessory 20, 120 may be made of thermoplastic, such as Acrylonitrile styrene acrylate (ASA). However, the ring accessory 20, 120 may be made of one or more other materials, such as fiber-reinforced plastic, carbon fiber, metal, etc.

FIG. 1 shows a pistol 10 with a first ring accessory 20 mounted thereto. The pistol 10 includes a frame 12, a trigger guard 14, a barrel 16, and a handgrip 18. The first ring accessory 20 includes an upper portion 22 configured to attach to the frame 12 of the pistol 10 beneath the barrel 16 and forward of the trigger guard 14. The first ring accessory 20 may be adjacent to the trigger guard 14, with the trigger guard 14 located between the first ring accessory 20 and the handgrip 18.

The first ring accessory 20 also includes a vertical portion 24 and a horizontal portion 26. The vertical portion 24 extends vertically downward from the upper portion 22, and the horizontal portion 26 is connected to the vertical portion 24 and extends horizontally therefrom toward the trigger guard 14. In some embodiments, and as shown in FIG. 1, the horizontal portion 26 extends parallel to and spaced apart from the upper portion 22.

The vertical portion 24 and the horizontal portion 26, together define, at least partiality, a horizontally-elongated aperture 28 configured to be gripped by two or more fingers of a non-shooting hand of a user. The two or more fingers may extend horizontally through the horizontally-elongated aperture 28, and a palm of the non-shooting hand may support the pistol 10 from beneath the horizontal portion 26.

Figure 2:
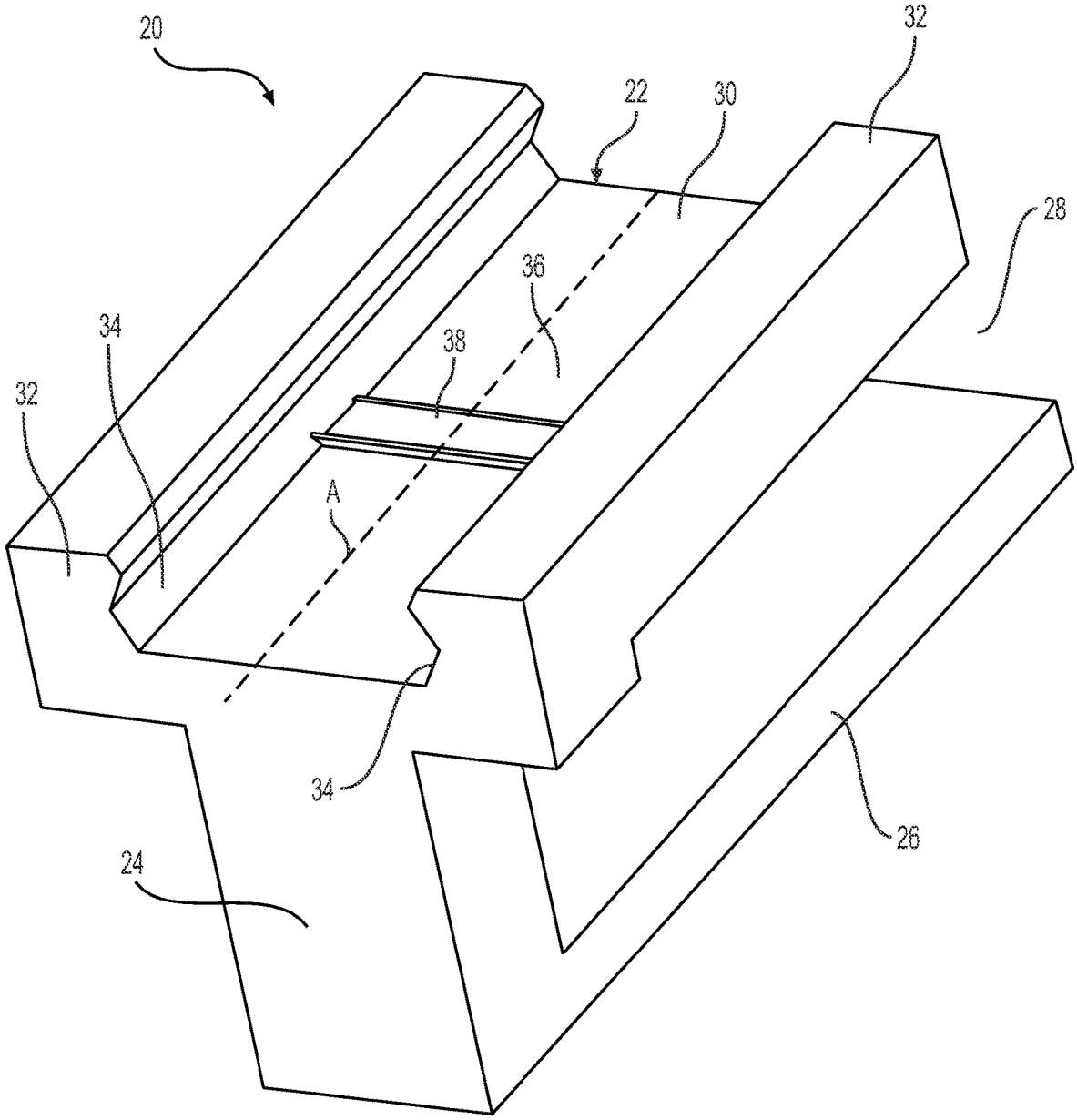
FIG. 2 shows a perspective view of the ring accessory of FIG. 1.

FIG. 2 shows a perspective view of the first ring accessory 20. In some embodiments, and as best shown in FIG. 2, the upper portion 22 includes a Picatinny rail mount configured to engage a corresponding Picatinny rail on the frame of the pistol 10 for attaching the upper portion 22 to the frame 12 of the pistol 10. As shown in FIG. 2, the upper portion 22 includes a base 30 having a rectangular shape extending along a major axis A that extends parallel to the barrel 16 when the first ring accessory 20 is mounted to the pistol 10. The upper portion 22 also includes two rail portions 32 extending along the two long edges of the base 30, parallel to the major axis A and extending upwardly, away from the vertical portion 24. Each of the two rail portions 32 includes a v-shaped trough 34 extending along a length thereof and facing inwardly toward the other one of the two rail portions 32. The two rail portions 32 and their corresponding v-shaped troughs 34, may together define the Picatinny rail mount. The upper portion 22 also includes a top face 36 facing upwardly, away from the vertical portion 24 and extending between the two the two rail portions 32. A protrusion 38 extends upwardly from the top face 36 between the two the two rail portions 32 for engaging a corresponding indentation on the frame 12 of the pistol 10 for limiting sliding movement along the corresponding Picatinny rail on the frame of the pistol 10 and further securing the attachment of the first ring accessory 20 to the pistol 10.

In some embodiments, and as shown in FIG. 1, the upper portion 22, the vertical portion 24, and the horizontal portion 26 of the first ring accessory 20 may together define a C-shaped cross-section. The trigger guard 14 of the firearm 10 may abut an open portion of the C-shaped cross-section to, at least partially, define the horizontally-elongated aperture 28. However, the first ring accessory 20 may have another cross-sectional shape to, at least partially, define the horizontally-elongated aperture 28. In some embodiments, the first ring accessory 20 may have a closed-shape, such as a rectangle, an oval, a rounded rectangle, or a racetrack, having an open center to define the horizontally-elongated aperture 28.

Figure 3:
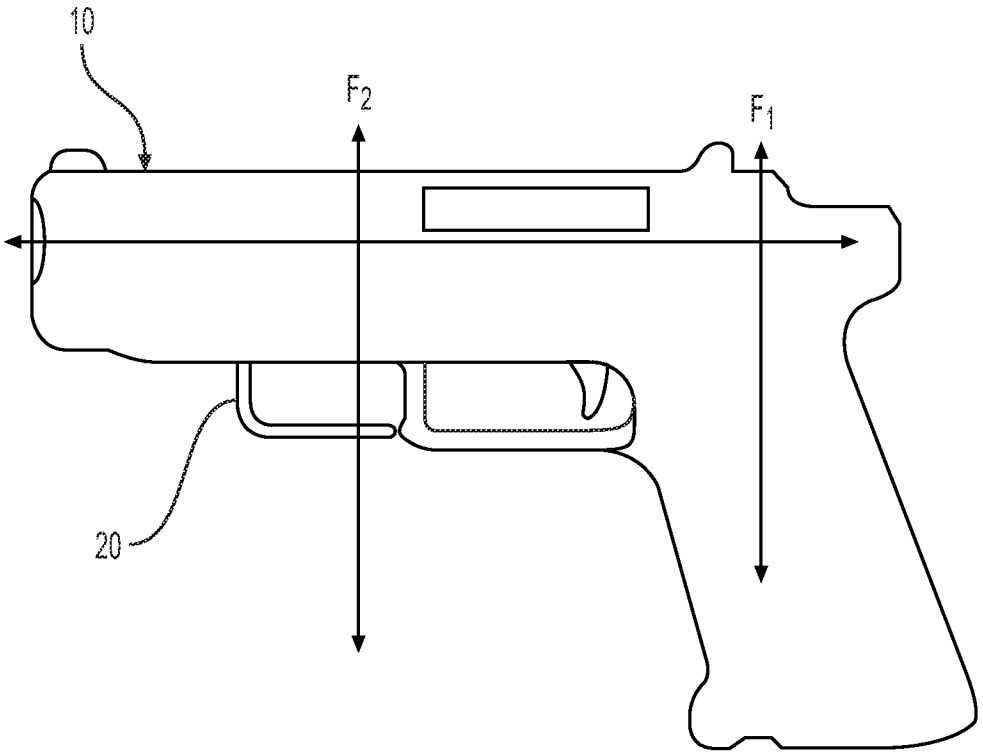
FIG. 3 shows a free body diagram of a pistol with the ring accessory, illustrating forces supporting the pistol in a conventional configuration, and using the ring accessory.

FIG. 3 shows a free body diagram of a pistol 10, with the first ring accessory 20. A first force arrow, F1 illustrates forces supporting the pistol 10 in a conventional configuration, with both hands of the shooter holding the handgrip. A second force arrow, F2 illustrates forces supporting the pistol 10 by a shooter using the first ring accessory 20.

Figure 5:
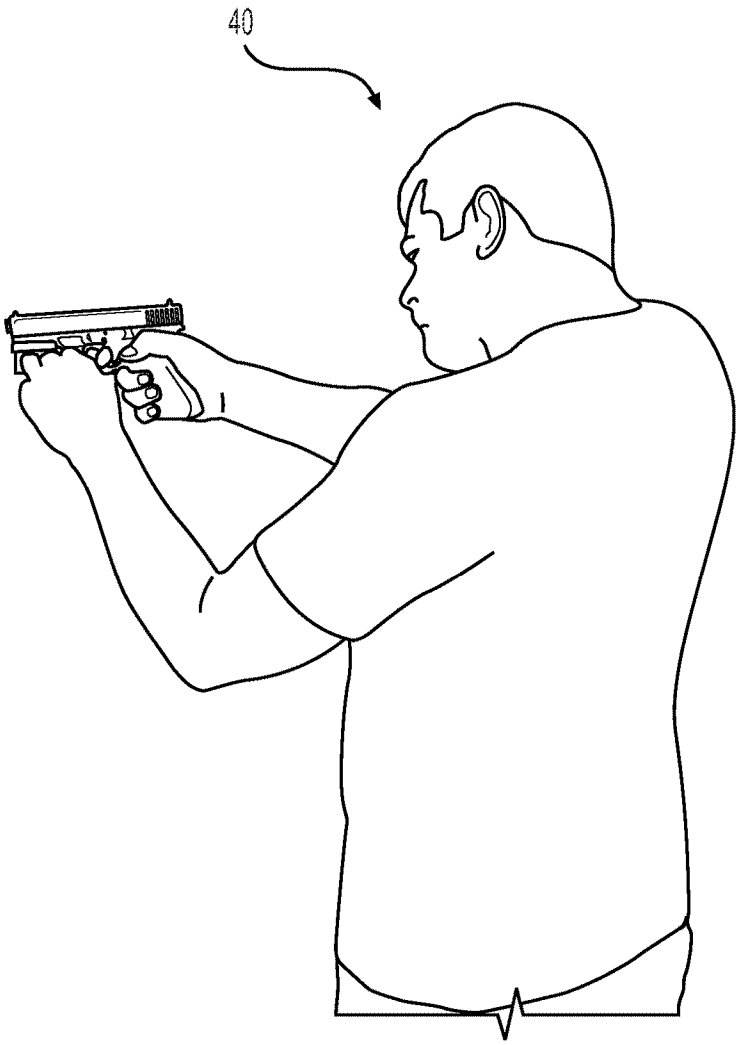
FIG. 5 shows a rear view of the person in the compact shooting stance using a pistol with the ring accessory, in accordance with an aspect of the present disclosure.
Figure 4:
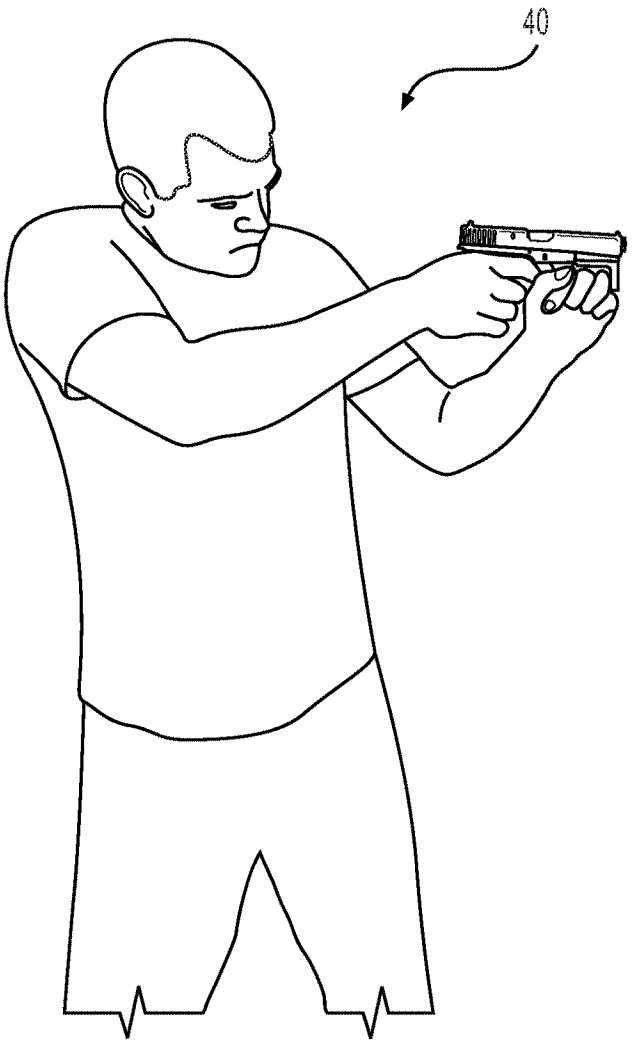
FIG. 4 shows a front view of a person in a compact shooting stance using a pistol with the ring accessory, in accordance with an aspect of the present disclosure.

FIG. 4 shows a front view of a person 40 in a compact shooting stance using a pistol with the first ring accessory 20. FIG. 5 shows a rear view of the person 40 in the compact shooting stance using a pistol with the first ring accessory 20.

Figure 6:
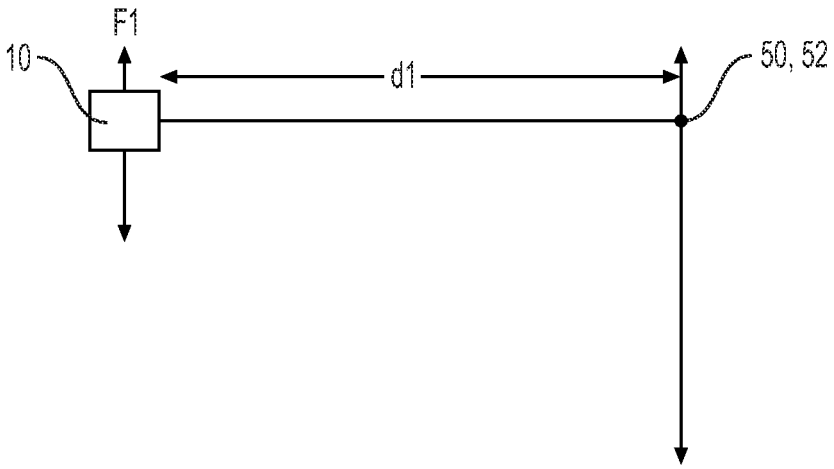
FIG. 6 is a diagram illustrating distribution of forces by a person holding a pistol in a conventional shooting stance.

FIG. 6 is a diagram illustrating distribution of forces by a person holding a pistol 10 in a conventional shooting stance, with both hands of the shooter holding the handgrip. The pistol 10 exerts first forces F1 including a downward force due to gravity and an upward force due to barrel flip when firing. As shown in FIG. 6, the arms of the person each extend forward from the corresponding shoulders 50, 52, defining a common fulcrum. The first forces F1 acting on the pistol 10 are transferred to the person at the common fulcrum. The person's arms are extended, and the pistol 10 is spaced from the common fulcrum by a first distance d1.

Figure 7:
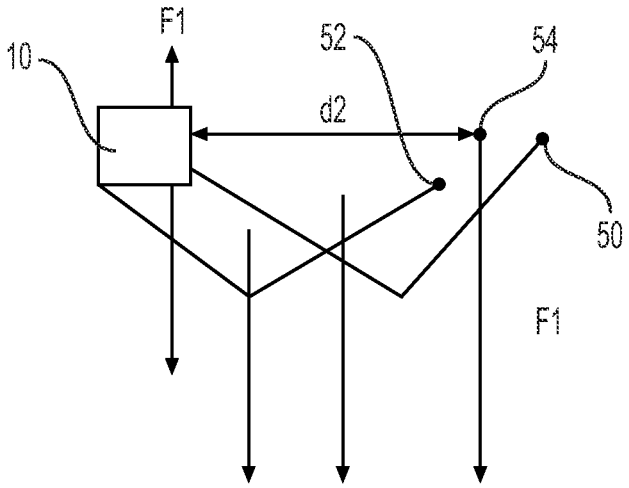
FIG. 7 is a diagram illustrating distribution of forces by the person in the compact shooting stance holding the pistol with the ring accessory.

FIG. 7 is a diagram illustrating distribution of forces by the person 40 in the compact shooting stance holding the pistol 10 with the first ring accessory 20. In the compact shooting stance using the first ring accessory 20, the first forces F1 acting on the pistol 10 are distributed downward and rearward through the two arms of the person. The first forces F1 act upon a fulcrum at an intermediate location 54 between the two shoulders 50, 52. The pistol 10 is spaced from the intermediate location 54 by a second distance d2. The second distance d2 is substantially shorter than the first distance d1, providing a shorter lever arm, and greatly reducing fatigue on the person as a result of the first forces F1 from holding the pistol 10. The second distance d2 may be, for example, one-half the first distance d1. The reduced lever arm d2 may also enable greater control of the pistol 10, allowing the person 40 to reduce barrel flip, and/or reducing time to come back to target after firing the pistol 10.

Figure 8:
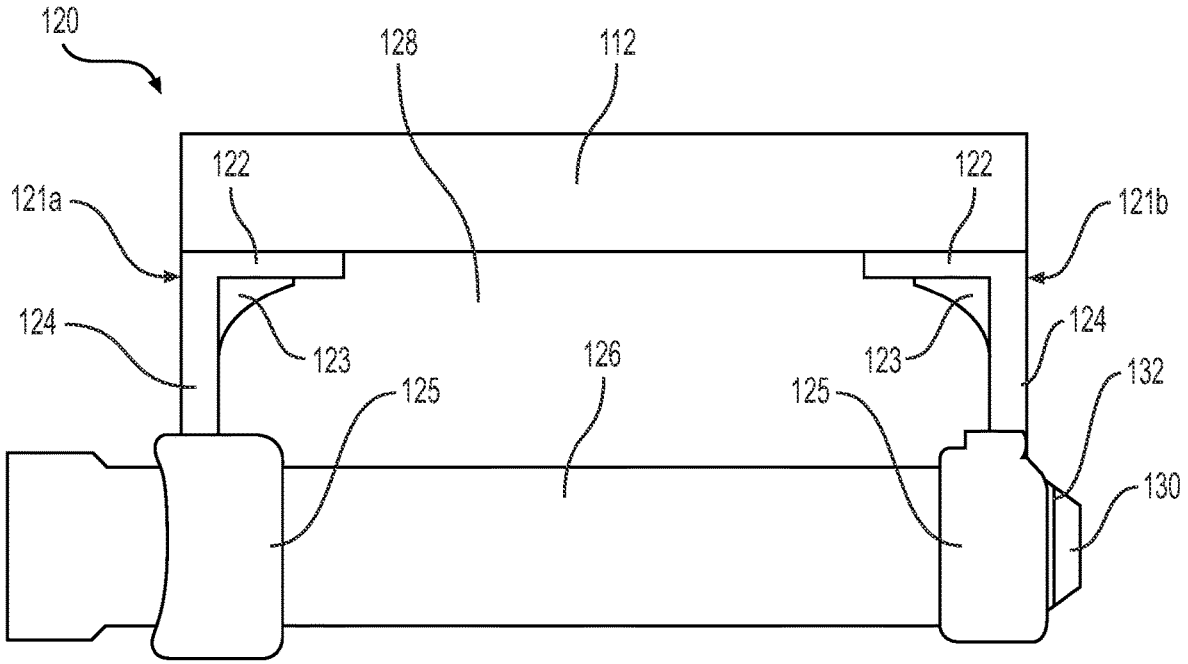
FIG. 8 shows a fragmentary side view of a ring accessory for a long gun, in accordance with an aspect of the present disclosure.

FIG. 8 shows a fragmentary side view of a second ring accessory 120 for a long gun. The second ring accessory 120 includes a vertical tube 126 that extends parallel to the barrel of the long gun (not shown), with the vertical tube 126 spaced apart from the barrel. The second ring accessory 120 includes one or more support members 121*a*, 121*b* configured to hold the vertical tube 126 to a frame 112 of the long gun. In some embodiments, the second ring accessory 120 may include a first support member 121*a* and a second support member 121*b*. Each of the support members 121*a*, 121*b* may have an identical construction. Alternatively, the second ring accessory 120 may include two support members 121*a*, 121*b* having different configurations. For example, the second support member 112*b* may be configured as a mirror image of the first support member 121*a*.

Figure 9:
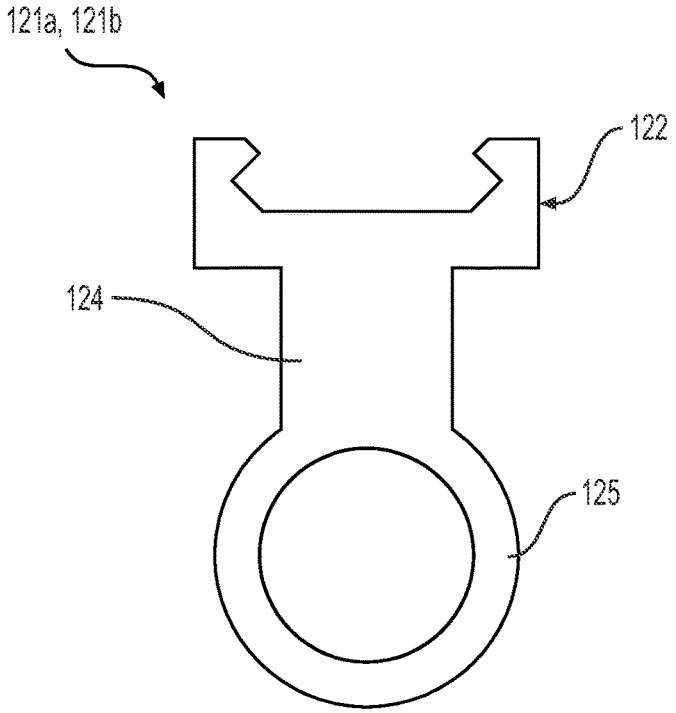
FIG. 9 shows a front view of a support member of the ring accessory of FIG. 8.

Each of the support members 121*a*, 121*b* includes an upper portion 122, a vertical portion 124, and a lower portion 125. The upper portion 122 is configured to fasten to the frame 112 of the long gun beneath the barrel and forward of the trigger guard. The lower portion 125 is connected to the upper portion 122 by the vertical portion 124 and is configured to hold the vertical tube 126. For example, the lower portion 125 may have a ring-shape, as shown in FIG. 9 for surrounding the vertical tube 126. The lower portion 125 may a different shape or other configuration for attachment to the vertical tube 126. A gusset 123 extends between the upper portion 122 and the vertical portion 124.

The vertical tube 126 and one or more of the support members 121*a*, 121*b* may together define a horizontally-elongated aperture 128 configured to be gripped by two or more fingers of a non-shooting hand of a user, with the two or more fingers extending horizontally therethrough, and with a palm of the non-shooting hand supporting the long gun from beneath the vertical tube 126. In some embodiments, and as shown in FIG. 8, the horizontally-elongated aperture 128 may have a size and shape configured to receive all four fingers (excepting the thumb) of the non-shooting hand of the user. The non-shooting hand may be the opposite hand from a shooting hand that is in a position to actuate a trigger of the firearm.

In some embodiments, the upper portion 122 includes a Picatinny rail mount configured to engage a corresponding Picatinny rail on the frame 112 of the long gun. The Picatinny rail mount may have a configuration similar or identical to that of the first ring accessory 20 shown in FIG. 2 and described herein.

In some embodiments, the second ring accessory 120 includes an illumination source having a body incorporating vertical tube 126. The illumination source may include, for example, a flashlight or a laser light, which may be used for aiming the firearm. In some embodiments, the second ring accessory 120 includes a button 130 button disposed on the vertical tube and configured to activate the illumination source. In some embodiments, the vertical tube 126 includes an end 132 facing toward the trigger guard, with the button 130 located on the end 132 of the vertical tube 126 facing toward the trigger guard and configured to be actuated by a thumb of the non-shooting hand. However, the button 130 may be located at a different location, such as on a side of the vertical tube 126 or remote from the vertical tube 126.

Figure 10:
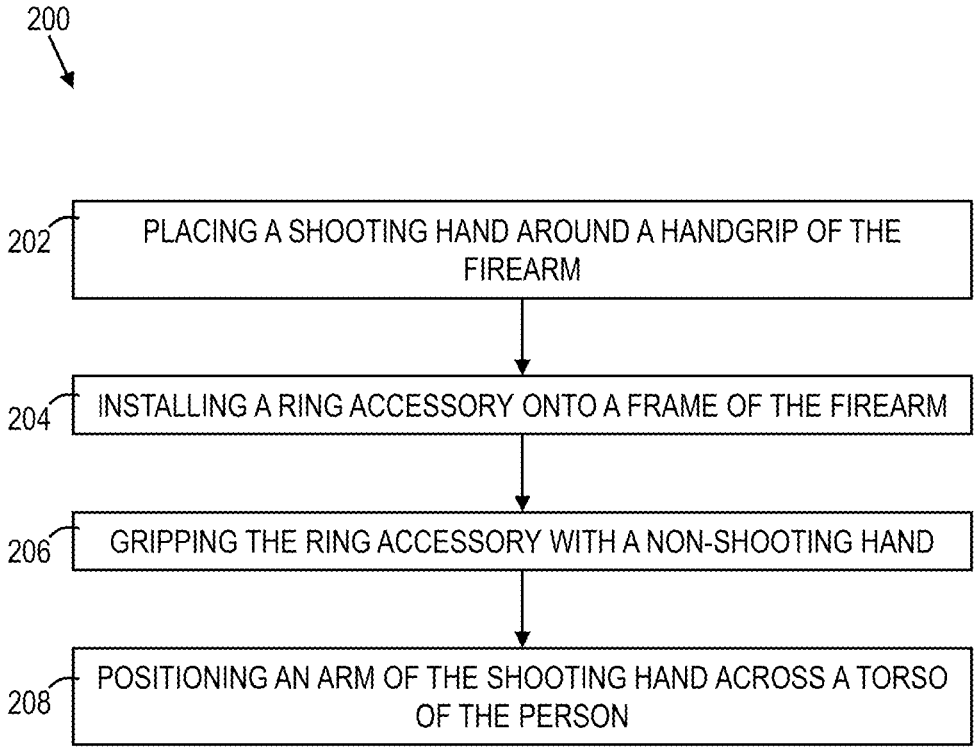
FIG. 10 shows a flowchart listing steps in a method for holding a firearm using a compact shooting stance.

FIG. 10 shows a flowchart listing steps in a method 200 for holding a firearm by a person using a compact shooting stance. The method 200 includes placing a shooting hand around a handgrip of the firearm at step 202, with an index finger of the shooting hand in position to pull a trigger of the firearm.

The method 200 also includes installing a ring accessory onto a frame of the firearm at step 204. Step 204 may include attaching an upper portion of the ring accessory to the frame of the firearm beneath a barrel of the firearm and forward of a trigger guard of the firearm. The ring accessory may include a vertical portion and a horizontal portion, with the vertical portion and the horizontal portion together defining a horizontally-elongated aperture.

The method 200 also includes gripping the ring accessory with a non-shooting hand at step 206. Step 206 may include placing two or more fingers of the non-shooting hand extending horizontally through the horizontally-elongated aperture, and with a palm of the non-shooting hand supporting the firearm from beneath the horizontal portion.

In some embodiments, the method 200 may further include positioning an arm of the shooting hand across a torso of the person at step 208. Step 208 may include the person having two shoulders aligned substantially parallel to the barrel. This compact stance may provide for the person having the torso turned sideways to the target. The compact stance may, therefore, provide for the person to present a smaller cross-sectional area to the target than other conventional stances, which can reduce the risk of being hit by a projectile coming from the direction of the target.

The foregoing description is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A ring accessory for a firearm having a frame, a trigger guard, and a barrel, the ring accessory comprising:

an upper portion configured to attach to the frame of the firearm beneath the barrel and forward of the trigger guard;

a vertical portion extending vertically downward from the upper portion a horizontal portion connected to the vertical portion and extending horizontally therefrom toward the trigger guard; and the vertical portion and the horizontal portion together defining a horizontally-elongated aperture configured to be gripped by two or more fingers of a non-shooting hand of a user, with the two or more fingers extending horizontally therethrough, and with a palm of the non-shooting hand supporting the firearm from beneath the horizontal portion;

wherein the upper portion, the vertical portion, and the horizontal portion together define a C-shaped cross-section; and wherein the trigger guard of the firearm abuts an open portion of the C-shaped cross-section to, at least partially, define the horizontally-elongated aperture.

2. The ring accessory of claim 1, wherein the upper portion further comprises a Picatinny rail mount configured to engage a corresponding Picatinny rail on the frame of the firearm.

3. A ring accessory for a firearm having a frame, a trigger guard, and a barrel, the ring accessory comprising:

a vertical tube extending parallel to the barrel and spaced apart therefrom for substantially an entire length of the vertical tube;

a first support member having an upper portion, a vertical portion, and a lower portion, the upper portion configured to fasten to the frame of the firearm beneath the barrel and forward of the trigger guard, the lower portion connected to the upper portion by the vertical portion and configured to hold the vertical tube; and the vertical tube and the support member together defining a horizontally-elongated aperture configured to be gripped by two or more fingers of a non-shooting hand of a user, with the two or more fingers extending horizontally therethrough, and with a palm of the non-shooting hand supporting the firearm from beneath the vertical tube.

4. The ring accessory of claim 3, wherein the upper portion further comprises a Picatinny rail mount configured to engage a corresponding Picatinny rail on the frame of the firearm.

5. The ring accessory of claim 3, wherein the two or more fingers of the non-shooting hand includes four fingers.

6. The ring accessory of claim 3, further comprising a second a support member configured to fasten to the frame of the firearm forward of the first support member and configured to hold the vertical tube.

7. The ring accessory of claim 6, wherein the first support member and the second support member have an identical construction.

8. The ring accessory of claim 5, further comprising an illumination source having a body incorporating the vertical tube.

9. The ring accessory of claim 8, wherein the illumination source is one of a flashlight or a laser light.

10. The ring accessory of claim 8, further comprising a button disposed on the vertical tube and configured to activate the illumination source.

11. The ring accessory of claim 10, wherein the vertical tube includes an end facing toward the trigger guard, with the button located on the end of the vertical tube facing toward the trigger guard and configured to be actuated by a thumb of the non-shooting hand.

* * * * *